US007046940B2

(12) United States Patent
Kim et al.

(10) Patent No.: US 7,046,940 B2
(45) Date of Patent: May 16, 2006

(54) DEVELOPING DEVICE HAVING A DEVELOPER SCATTER PREVENTION UNIT AND AN ELECTROPHOTOGRAPHIC IMAGE FORMING APPARATUS USING THE SAME

(75) Inventors: Jeong-seon Kim, Suwon-si (KR); Hyun-cheol Lee, Suwon-si (KR); Young-wok Seo, Suwon-si (KR); Valery KrasnosloBoditsev, Suwon-si (KR); Dong-lyoul Shin, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/986,295

(22) Filed: Nov. 12, 2004

(65) Prior Publication Data

US 2005/0111874 A1 May 26, 2005

(30) Foreign Application Priority Data

Nov. 22, 2003 (KR) ..... 10-2003-0083400

(51) Int. Cl.
*G03G 15/08* (2006.01)

(52) U.S. Cl. ..... 399/98; 399/99

(58) Field of Classification Search ..... 399/98
See application file for complete search history.

(56) References Cited

U.S. PATENT DOCUMENTS 5,862,440 A * 1/1999 Christy et al. ..... 399/99

FOREIGN PATENT DOCUMENTS

| | | |
|---|---|---|
| JP | 62-194271 | 8/1987 |
| JP | 64-055575 | 3/1989 |
| JP | 06-202458 | 7/1994 |
| JP | 2002-138956 | 5/2002 |

* cited by examiner

*Primary Examiner*—Quana Grainger
(74) *Attorney, Agent, or Firm*—Stanzione & Kim, LLP

(57) ABSTRACT

A developer scattering prevention unit used with an electrophotographic image forming device includes an air inlet/outlet pipe installed adjacent to an intermediate area between an image carrier and a developer and having a first air inlet/outlet port opened toward the intermediate area, and at least one vacuum source installed on at least one of the image carrier and the developer carrier to communicate with the air inlet/outlet pipe to control air to flow from the intermediate area through the first air inlet/outlet port. A developing device having this developer scattering prevention function becomes simplified in structure.

27 Claims, 5 Drawing Sheets

DEVELOPING DEVICE HAVING A DEVELOPER SCATTER PREVENTION UNIT AND AN ELECTROPHOTOGRAPHIC IMAGE FORMING APPARATUS USING THE SAME

CROSS-REFERENCE TO RELATED APPLICATIONS

This application claims the benefit of Korean Patent Application No. 2003-83400, filed on Nov. 22, 2003, in the Korean Intellectual Property Office, the disclosure of which is incorporated herein by reference in its entirety.

BACKGROUND OF THE INVENTION

1. Field of the Invention

The present general inventive concept relates to an image forming apparatus, and in particular, to a developing device used with an electrophotographic image forming apparatus, which comprises an image carrier and a developer carrier to print an image onto a print medium, and further comprises a developer scattering prevention unit to prevent a developer from scattering between the image carrier and the developer carrier.

2. Description of the Related Art

Image forming apparatuses, such as printers, copying machines, facsimiles and multifunction peripherals, are typically used for printing an image onto a print medium and classified into ink-jet image forming apparatuses and electrophotographic image forming apparatuses depending on printing types thereof.

FIG. 1 shows a conventional electrophotographic image forming apparatus (laser beam printer) 100.

Referring to FIG. 1, the electrophotographic image forming apparatus 100 comprises a paper-feeding device 110, a developing device 120 and a plurality of rollers 101 to 103 for transferring print mediums from the paper-feeding device 110.

The developing device 120 comprises an image carrier 121 for printing an image on a print medium, a laser scan unit 129 for causing an electrostatic latent image to be formed on the image carrier 121, a cartridge 125 for receiving developer T in a housing 128 thereof, a developer carrier 122 for feeding the developer in such a way that an image is formed according to the electrostatic latent image, and an image transfer member 124. The image carrier 121 and the developer carrier 122 are formed in a roller shape as shown in FIG. 1 or in a belt shape depending on a type of the image forming apparatus 100.

In the developing device 120 constructed as described above, air flows between the image carrier 121 and the developer carrier 122 along a rotating direction of the image carrier 121 (along a running (moving) direction of the image carrier 121 if the image carrier 121 is formed in the belt shape) as the image carrier 121 rotates (see arrow A in FIG. 2). Due to this, the developer may scatter through a space between the image carrier 121 and the developer carrier 122, and accordingly, there is a problem in that the developer leaks out of the developing device 120. In order to solve this problem, modern developing devices are further provided with a developer scattering prevention unit.

FIG. 2 shows a developing device for an image forming apparatus provided with a conventional developer scattering prevention unit 130.

Referring to FIG. 2, the conventional developer scattering prevention unit 130 comprises a pair of vacuum sources 131 driven separately from an image carrier 121 and a developer carrier 122, and a pair of duct members 133 located adjacent to an intermediate area between the image carrier 121 and the developer carrier 122. For reference, a reference numeral 135 indicates a filter member for filtering a suctioned developer.

A developing device provided with a developer scattering prevention unit 130 is disclosed in Japanese Patent Publication No.: Hei 11-327295.

Meanwhile, the developing device 120 provided with such a conventional developer scattering prevention unit 130 as described above has to separately include a motor (not shown), a power source connection means for connecting a power source to the motor, and a control device 140 for controlling the motor, because each of the pair of vacuum sources 130 has to be driven separately from the image carrier 121 and the developer carrier 122. Accordingly, there are problems in that a process for manufacturing such a developing device becomes complicated because the construction of the developing device 120 is complicated, and in that manufacturing costs of such a developing device are increased because constituent elements are added.

SUMMARY OF THE INVENTION

In order to solve the above and/or other problems, it is an aspect of the present general inventive concept to provide a developing device having a developer scattering prevention unit which can simply and inexpensively prevent a developer from scattering between an image carrier and a developer carrier.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept may be achieved by providing a developing device used with an electrophotographic image forming device comprising an image carrier, a developer carrier to feed a developer to the image carrier, a developer scattering prevention unit to prevent the developer from scattering between the image carrier and the developer carrier, wherein the developer scattering prevention unit comprises an air inlet/outlet pipe installed adjacent to an intermediate area between the image carrier and the developer carrier and having a first air inlet/outlet port opened toward the intermediate area, and at least one vacuum source installed on at least one of the image carrier and the developer carrier to be capable of communicating with air through the air inlet/outlet pipe, the vacuum source controlling air at the first air inlet/outlet port to flow.

The vacuum source may comprise at least one fan member rotatably installed at one or more ends of at least one of the image carrier and the developer carrier, and at least one casing to enclose the at least one fan member, each casing comprising a second air inlet/outlet port connected to the air inlet/outlet pipe, a third air inlet/outlet port connected to the second air inlet/outlet port to be capable of communicating with the air through the second air inlet/outlet port, and a first flow passage to connect the second and third air inlet/outlet ports, wherein the fan member is located in the first flow passage.

The at least one fan member may be installed on a rotary shaft of at least one of the image carrier and the developer carrier, so that the least one fan member can be rotationally driven in unison with the at least one of the image carrier and the developer carrier.

The fan member may be formed in a shape to control air to be suctioned into the casing through the second air/inlet port or in a shape to control air to pass through the first air inlet/outlet port and the air inlet/outlet pipe in sequence and to be suctioned into the casing, when the fan member is rotationally driven.

The developer scattering prevention unit may further comprise a filter member installed downstream of the third air inlet/outlet port along an air flow direction.

The filter member may be installed to enclose a fourth air inlet/outlet port formed through a side wall of a housing enclosing the image carrier and the developer carrier in such a way that the fourth air inlet/outlet port is connected with the third air inlet/outlet port, or removably installed on a side of the casing to cover the third air inlet/outlet port.

When the filter member is installed to cover the third air inlet/outlet port, the filter member may have a surface area larger than a cross-sectional area of the third air inlet/outlet port.

When the vacuum source is installed on one end of any one of the image carrier and the developer carrier, which is formed in a roller shape, the developing unit may further comprise a second flow passage formed within the air inlet/outlet pipe to connect the first and second air inlet/outlet pipes, the second flow passage being formed in a shape which is gradually narrowed as being away from the second air inlet/outlet port, and the first air inlet/outlet port is formed in a shape which is gradually widened as being away from the second air inlet/outlet port.

When a pair of vacuum sources are installed on opposite ends of any one of the image carrier and the developer carrier, which is formed in a roller shape, the developing unit may further comprise a second flow passage formed within the air inlet/outlet pipe to connect the first and second air inlet/outlet pipes, the second flow passage being formed in a shape which is gradually narrowed as approaching from the second air inlet/outlet port to the center part of the air inlet/outlet pipe and the first air inlet/outlet port is formed in a shape which is gradually narrowed as approaching from the second air inlet/outlet port to the center part of the air inlet/outlet pipe.

It is possible to prevent an air suction efficiency through the first air inlet/outlet port from decreasing as the first air inlet/outlet port is away from the vacuum source.

It is also possible that the first air inlet/outlet port is formed in a slit shape longitudinally parallel to a main axis of any one of the image carrier and the developer carrier, which is formed in a roller shape.

An inlet and an outlet directions of the air may vary depending on types of fan members. If the fan member is formed as an axial flow fan, a traveling direction of air passing through the second and third air inlet/outlet ports is parallel to a main axis of any one of the image carrier and the developer carrier, which is formed in a roller shape. Whereas, if the fan member is formed as a centrifugal fan, the traveling direction of air passing through the second air inlet/outlet port can be parallel to the main axis of any one of the image carrier and the developer carrier, which is formed in a roller shape, and the traveling direction of air passing through the second air inlet/outlet port can be inclined to the main axis by a predetermined angle.

The first flow passage can be formed along an inner circumferential surface of the casing by a partition wall formed within the casing, and the second and third air inlet/outlet ports can be isolated from each other that they are connected with each other via only the first flow passage.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
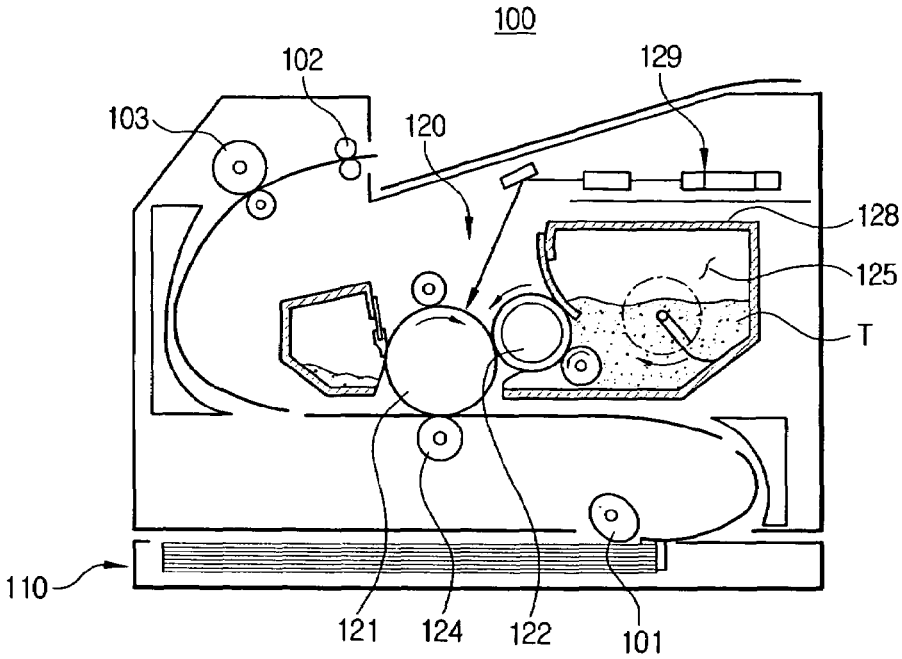
FIG. 1 (PRIOR ART)
FIG. 1 shows a conventional electrophotographic image forming apparatus.
Figure 2:
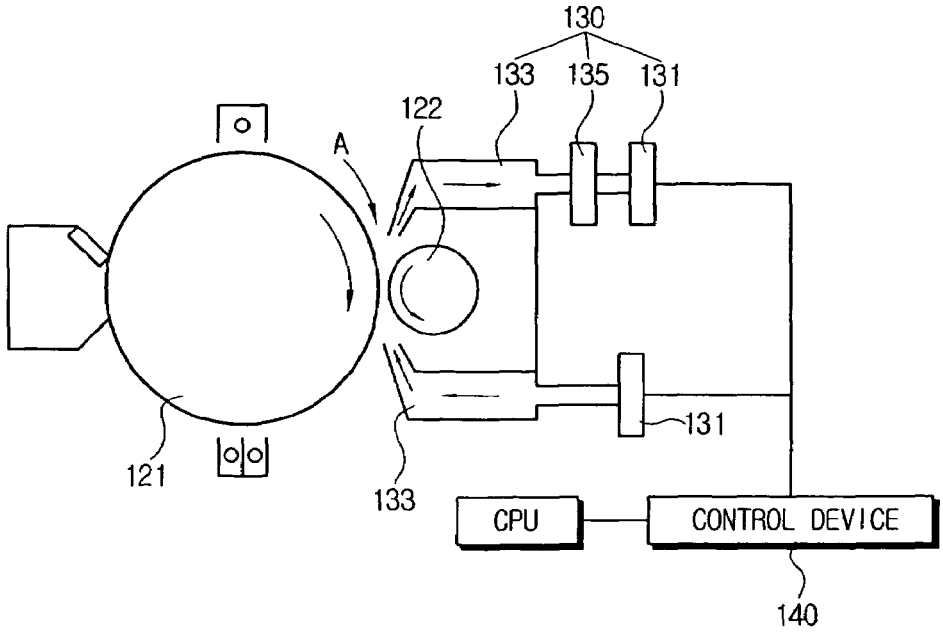
FIG. 2 (PRIOR ART)
FIG. 2 shows a developing device for an image forming apparatus, which provided with a conventional developer scattering prevention unit.

Reference will now be made in detail to the embodiments of the present general inventive concept, examples of which are illustrated in the accompanying drawings, wherein like reference numerals refer to the like elements throughout. For reference, in the following description of embodiments of the present invention, constituent elements having same constructions and functions with those described in the description of prior art and shown in FIGS. 1 and 2 will be designated by reference numerals same with those used in the description of prior art.

Figure 3:
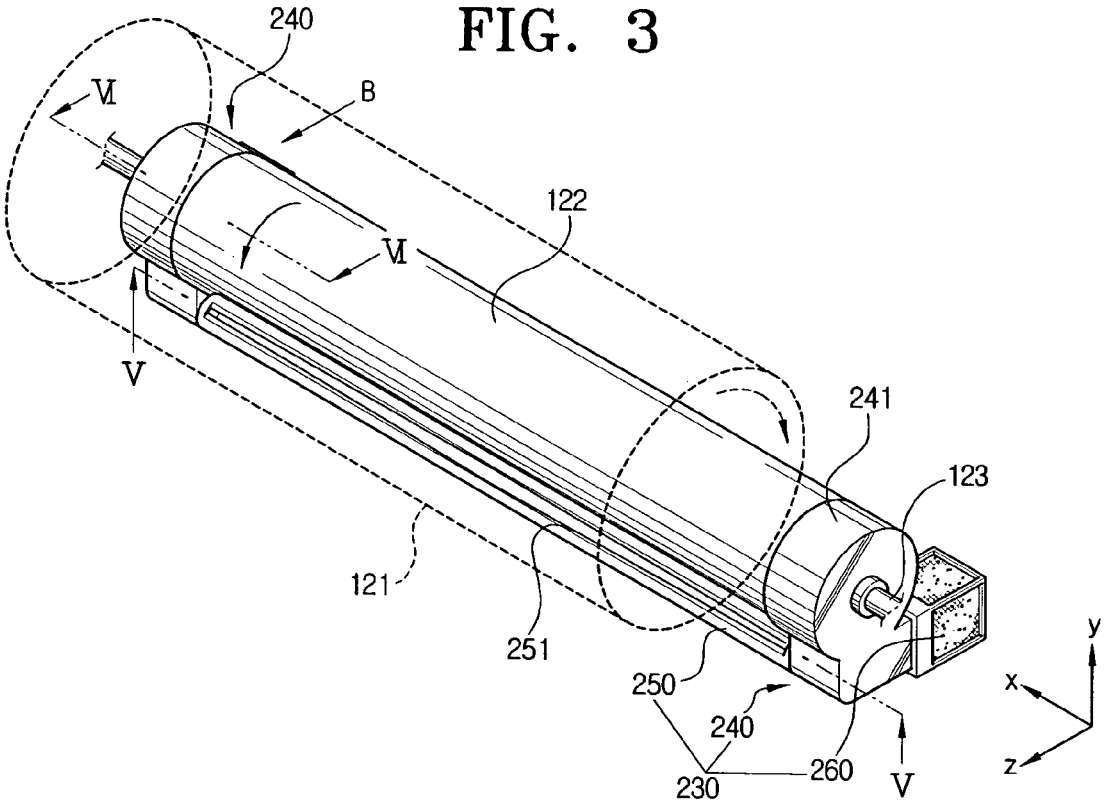
FIG. 3 shows a developing device used with an image forming apparatus according to an embodiment of the present general inventive concept.

FIG. 3 shows a developing device used with an image forming apparatus according to an embodiment of the present general inventive concept.

Referring to FIG. 3, the developing device may comprise an image carrier 121, a developer carrier 122, and a developer scattering prevention unit 230. The developer scattering prevention unit 230 may comprise a pair of vacuum sources 240 and an air inlet/outlet pipe 250.

The vacuum sources 240 are installed at opposite ends of the developer carrier 122, respectively. If the image carrier 121 is formed in a roller shape, and the developer carrier 122 is formed in a belt shape, the vacuum sources 240 may be installed at opposite ends of the image carrier 121. In addition, if both of the image carrier 121 and the developer carrier 122 are formed in a roller shape, the vacuum sources 240 may be provided on both of the image carrier 121 and the developer carrier 122 if desired.

Figure 4:
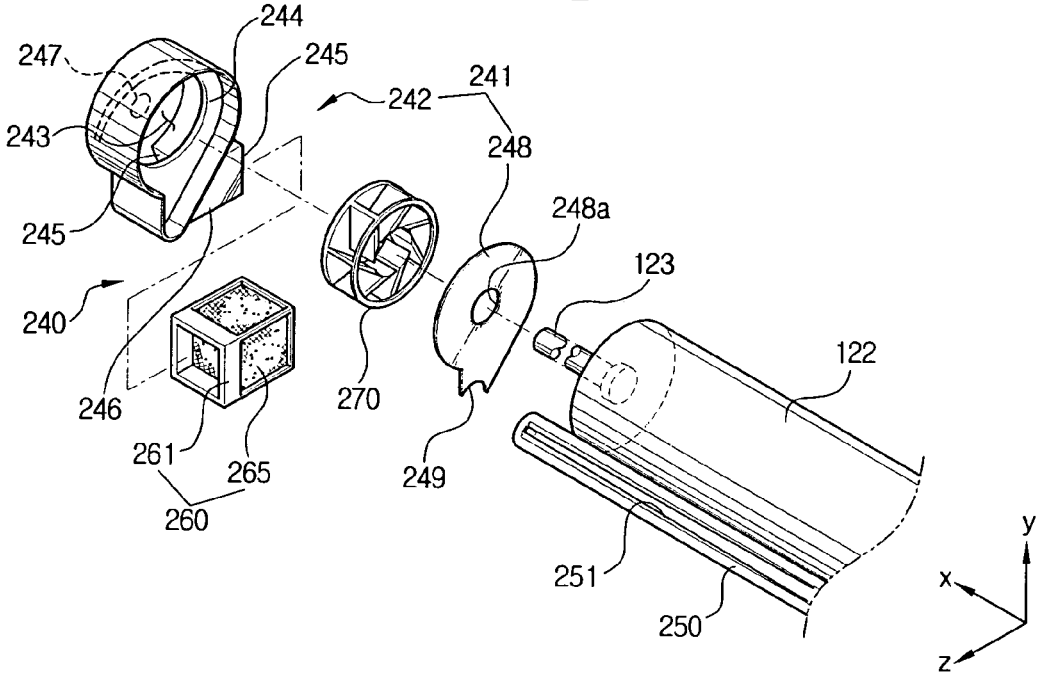
FIG. 4 is an exploded perspective view showing a developer scattering prevention unit of the developing device shown in FIG. 3.

As shown in FIG. 4, each vacuum source 240 may comprise a fan member 270, a casing 241 enclosing the fan member 270, and a filter 260.

The fan member 270 is connected to a rotary shaft 123 of the developer carrier 122 at a center part thereof and rotates in unison with the developer carrier 122 which is rotationally driven by a rotation source (not shown). In addition, the fan member 270 may have a shape which causes surrounding air of an first inlet/outlet port 251 to be suctioned together with a scattered developer (indicated by T in FIG. 1) into the air inlet/outlet pipe 250 through the first air inlet/outlet port 251 when the fan member 270 rotates according to a rotation of the developer carrier 122.

Figure 6:
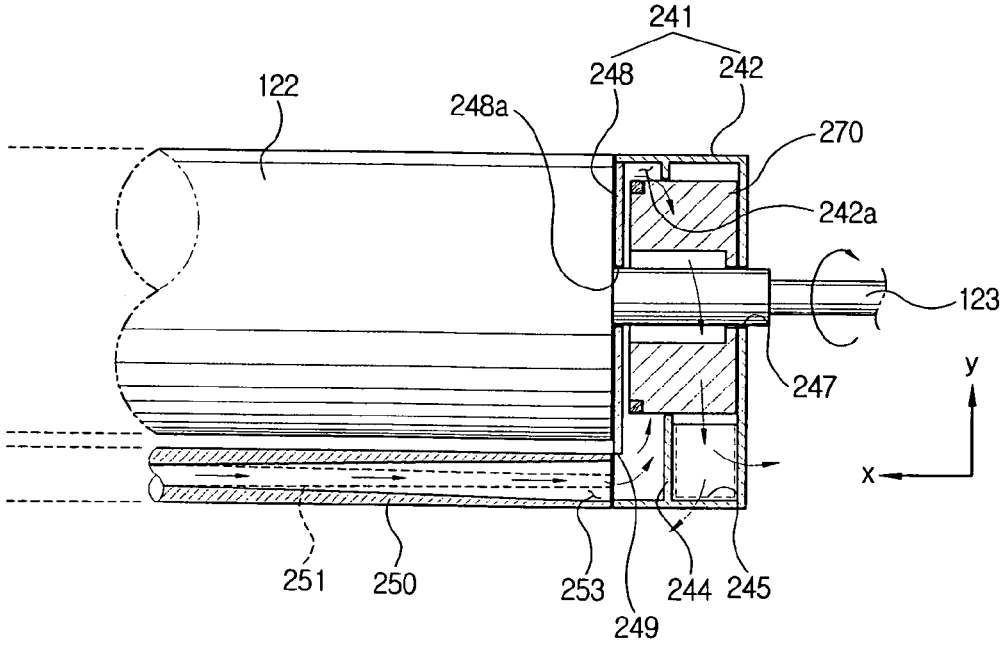
FIG. 6 is a cross-sectional view taken along a line VI—VI of FIG. 3 in a direction B to show a operational condition of the developer scattering prevention unit of FIG. 4.

The casing 241 may comprise a first casing part 242 to enclose an outer circumference of the fan member 240 and a second casing part 248 to cover an open end of the first casing part 248. The first casing part 242 has a hollow part 243 formed at its interior, within which the fan member 270 is rotatably received, and a first through-hole 247 into which the rotary shaft 123 of the developer carrier 122 is inserted. The second casing part 248 is formed in a plate shape and may have a second through-hole 248*a* through which the rotary shaft 123 of the developer carrier 122 is inserted into the first costing part 242 and the fan member 270, and a second air inlet/outlet port 249 formed at a side of the second casing 248 and connected to an open end of the air inlet/outlet pipe 250. As shown in FIG. 6, air suctioned into the casing 241 through the second air inlet/outlet port 249 is guided by a first air flow passage 242*a* formed by a partition wall 244 formed on an inner circumferential surface of the casing 242. That is, the air suctioned into the casing 241 is guided along an inner circumferential surface of the first casing part 242 by the first air flow passage 242*a* and then discharged through a third air inlet/outlet port 245 of a vent duct 246.

Figure 9:
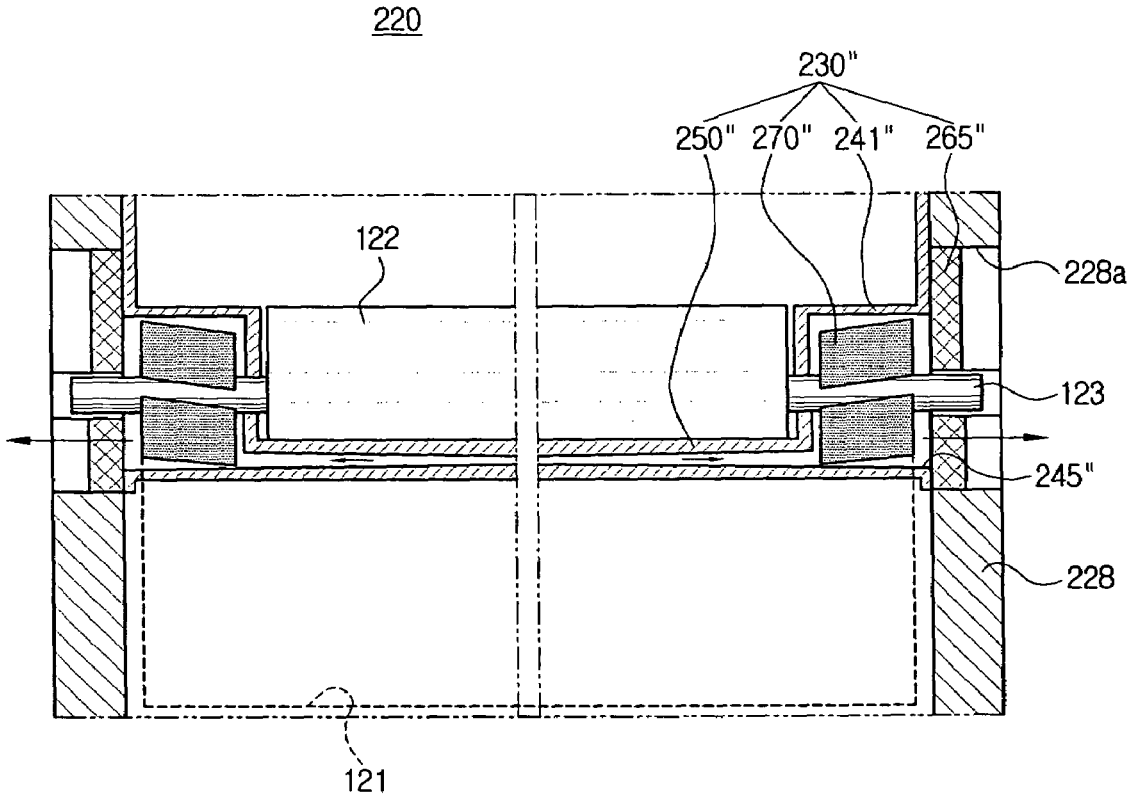
FIG. 9 is a cross-sectional view showing a developing device provided with a developer scattering prevention unit according to another embodiment of the present general inventive concept.

The filter 260 can be installed in the vent duct 246 to strain out a developer from the air discharged through the third air inlet/outlet port 245. The filter 246 according to the present embodiment may comprise a frame 261 in a shape of rectangular hexahedron, and a porous filter member 265 installed to surround open parts of the frame 261. It is not necessary to form the filter 260 in a shape of rectangular hexahedron. The filter 260 may be formed in a conical or cylindrical shape. In this case, the filter 260 is formed to have a surface area larger than a cross-sectional area of the third air inlet/outlet port 245. The third air inlet/outlet port 245 can be required to be prevented from being blocked by the developer strained out by the filter member 265, so that an air flow within the casing shall not be disturbed. If the vent duct 246 is exposed out of a housing 228 of a developing device 220 as shown in FIG. 9, the filter 260 described above can be removably installed in the vent duct 246 exposed out of the developing device.

Meanwhile, the air inlet/outlet pipe 250 is positioned adjacent to an intermediate area between the image carrier 121 and the developer carrier 122 and may have a tubular shape with opposite ends which are opened. In addition, the air inlet/outlet pipe 250 may comprise the first air inlet/outlet port 251 formed through a side of the air inlet/outlet pipe 250, and a second air flow passage 253 formed within the air inlet/outlet pipe 250 in such a way that its opposite ends are opened, thereby connecting the first air inlet/outlet port 251 to a pair of vacuum sources 240 when the open ends are connected to corresponding ones of the vacuum sources 240. Although it is described that the air inlet/outlet pipe 250 is formed in a tubular shape, it is possible to realize same functions and effects as in the air inlet/outlet pipe 250 even if such an air inlet/outlet pipe is formed in a duct shape. Furthermore, although the first air inlet/outlet port 251 is shown as one elongate slit shape, it is possible to realize same functions and effects as in the present embodiment even if such an air inlet/outlet port 251 is formed by a plurality of divided slits.

Figure 5:
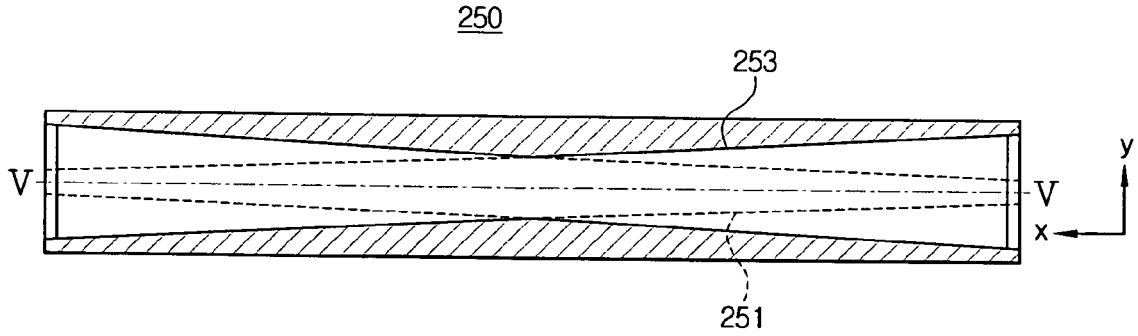
FIG. 5 is a cross-sectional view taken along a line V—V of FIG. 3, which shows an interior of an air inlet/outlet pipe of the developer scattering prevention unit of FIG. 4.

Meanwhile, the first air inlet/outlet port 251 and the second air flow passage 253 of the first air inlet/outlet pipe 250 are formed to have specific forms in order to enhance an air and/or developer suction efficiency. Referring to FIG. 5, it can be appreciated that the first air inlet/outlet port 251 is formed in a shape which is gradually widened as approaching to the longitudinal center thereof, while the second air flow passage 253 is formed in a shape which is gradually narrowed as approaching to the longitudinal center thereof. This is to prevent the suction efficiency of the first air inlet/outlet port 251 from being deteriorated, according to a distance between a portion of the first air inlet/outlet port 251 and the vacuum sources 240. That is, by forming the first air inlet/outlet port 251 and the second air flow passage 253 as described above, an air flow rate can be higher in the center part where the suction efficient is low, than in the opposite ends where the suction efficient is high. It is possible to accomplish an effect that the suction efficiency through the first air inlet/outlet port 251 becomes uniform along a main axis of the air inlet/outlet pipe 250.

In the afore-mentioned embodiment, the fan member 270 is formed in a shape which allows air to be suctioned through the first air inlet/outlet port 251. However, it is also possible to form the fan member 270 in a shape which causes air to be discharged through the first air inlet/outlet port 251. In this case, because an air flow is generated opposite to this embodiment, it is possible to omit the filter 260, thereby simplifying the construction of the developing device. However, with such a construction, an air flow A (see FIG. 2) generated by the image carrier 121 and another air flow generated by the fan member 270 are opposite to each other as described in an description of FIGS. 1 and 2. In particular, with an image forming apparatus provided with the image carrier 121 rapidly rotating for high speed image printing, the air flow generated by the image carrier 121 and the air flow generated by the fan member 270 run against one another, whereby an image quality may deteriorate. Therefore, when the construction of the fan member 270 is changed to turn the direction of the air flow, the afore-mentioned problem can be sufficiently taken into consideration.

Figure 7:
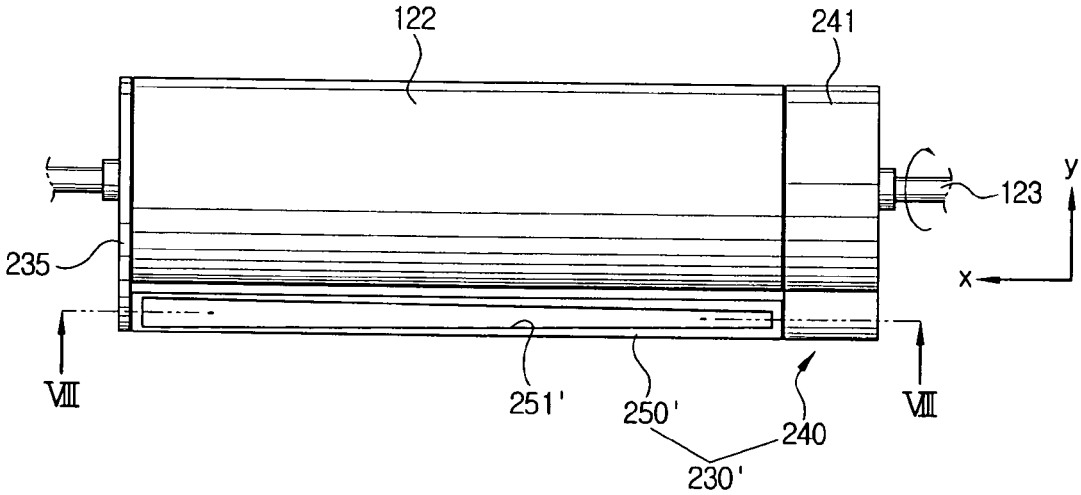
FIG. 7 shows a developer scattering prevention device according to another embodiment of the present general inventive concept.

FIG. 7 shows a developing device with a developer scattering prevention unit 230' according to another embodiment of the present general inventive concept.

The developer scattering prevention unit 230' according to this embodiment is same as that of the previous embodiment of FIGS. 3–6 in that it also comprises a vacuum source 240 and an air inlet/outlet pipe 250'; however, the former is different from the latter in that the former further comprises a support bracket 235. Such a support bracket 235 serves to support one end of the air inlet/outlet pipe 250' and may be omitted depending on the construction of the developing device. Meanwhile, the vacuum source 240 has an identical basic construction to that of the embodiment of FIGS. 3–6, except that it is installed in only one end of the developer carrier 122 or the image carrier 121. Therefore, its description will be omitted herein.

Figure 8:
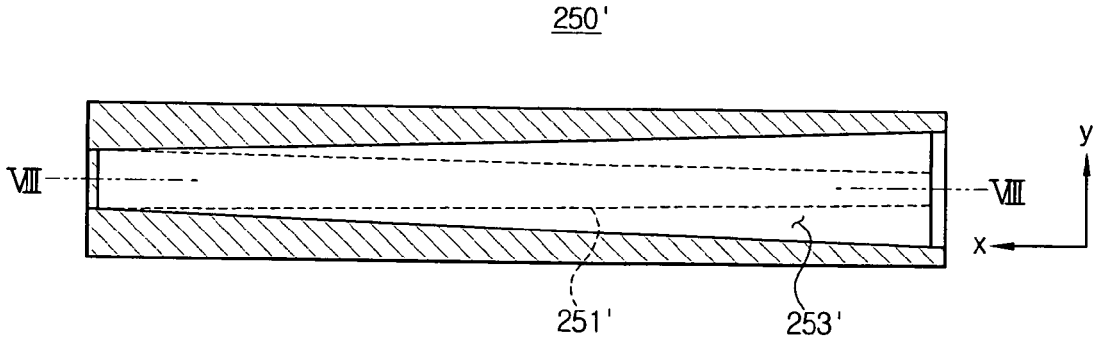
FIG. 8 is a cross-sectional view taken along a line VIII—VIII of FIG. 7, which shows an interior of an air inlet/outlet pipe of the developer scattering prevention unit of FIG. 7.

Meanwhile, the air inlet/outlet pipe 250' has a shape different from that of FIGS. 3–6 in terms of a practical position of the vacuum source 240. Basically, it can be said that the air inlet/outlet pipe 250' is same as that of FIG. 3 in that it is formed in a tubular shape parallel to the principle axis of the image carrier 122. However, the first air inlet/outlet port 251' and the second air flow passage 253' are different from those of the embodiment of FIG. 3 in construction. Referring to FIG. 8, the first air inlet/outlet port 251' can be gradually widened as approaching to an end of the developer carrier 122 provided with the support bracket 235 (FIG. 7). In addition, the second air flow passage 253' is closed at the end provided with the support bracket 235 and is narrowed as approaching to that end. This is because, an air suction force generated in the first air inlet/outlet port 251' generated by the vacuum source 240 is reduced as being away from the vacuum source 240. Therefore, even if the vacuum source 240 is installed at one end of the image carrier 122, it is possible to render an air and/or developer suction efficiency to be kept constant throughout the air inlet/outlet pipe 250'.

FIG. 9 shows a developing device 220 with a developer scattering prevention unit 230" according to another embodiment of the present general inventive concept.

Referring to FIG. 9, the developer scattering prevention unit 230" may be similar to those of the previous embodiments in that it comprises a vacuum source including a casing 241" and a fan member 270", and an air inlet/outlet pipe 250". However, because the fan member 270" of the developer scattering prevention unit 230" according to the present embodiment differs from those of the previous embodiments, the entire construction of the developing device 220 can be changed.

The fan member 270" can be formed in an axial flow type rather than in a centrifugal flow type of the previous embodiments. In the previous embodiments, because the fan member 270 (FIG. 4) is formed in the centrifugal flow type, a direction of air flowing into the casing 241 (FIG. 4) and a direction of air discharged out of the casing 241 can be intersected perpendicular to each other. However, according to another aspect of the present general inventive concept, air flows into and is discharged out of the casing 241" parallel to a principle axis (rotation axis) of the developer carrier 122. Due to this, a fourth air inlet/outlet port **228*a* connected with the third air inlet/outlet port 245" of the casing 241" may be separately formed through the housing 228 of the developing device 220, and a filter member 265" has to be formed to enclose the fourth air inlet/outlet port 228*a*. In this case, because it is not needed to separately provide a space for installing such a filter 260 (see FIG. 4) as in the previous embodiments, it is possible to reduce an entire volume of the developing device 220** and to simplify the construction thereof.

According to an aspect of the present general inventive concept as described in FIGS. 3–9, the fan member 270 or 270" to control the air and/or the developer to flow can be integrally formed with the rotary shaft 123 of the image carrier 121 and/or the developer carrier 122, whereby the fan member 270, 270" can rotate in unison with the image carrier 121 and/or the developer carrier 122 when the developing device 220 for recording an image is driven. Accordingly, because it is not needed to drive the vacuum source 240 using a separate driving source and control signals as in the conventional developing device, the construction of such a developing device 220 is simplified. Therefore, it is possible to reduce manufacturing processes and costs of such a developing device 220.

Moreover, according to the present invention, it is possible to prevent an air suction force through the air inlet/outlet member 250', 250" from decreasing as being away from the vacuum source by modifying the shape of the air inlet/outlet member 250, 250', or 250". Consequently, it is possible to provide a developing device having a developer scattering prevention unit improved in developer suction efficiency through the air inlet/outlet member 250.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A developing device used with an electrophotographic image forming device, comprising:

an image carrier;

a developer carrier to feed a developer to the image carrier; and a developer scattering prevention unit to prevent the developer from scattering between the image carrier and the developer carrier, the developer scattering prevention unit comprising:

an air inlet/outlet pipe installed adjacent to an intermediate area between the image carrier and the developer carrier, and having a first air inlet/outlet port being open toward the intermediate area, and at least one vacuum source installed on at least one of the image carrier and the developer carrier to communicate with the air inlet/outlet pipe and to operate to control air to flow through the first air inlet/outlet port according to a movement of the at least one of the image carrier and the developer carrier.

2. The developing device as claimed in claim 1, wherein the vacuum source comprises:

at least one fan member rotatably installed at one or more ends of the at least one of the image carrier and the developer carrier; and at least one casing to enclose the at least one fan member, and comprising a second air inlet/outlet port connected to the air inlet/outlet pipe, a third air inlet/outlet port connected to the second air inlet/outlet port to communicate with air through the second air inlet/outlet port, and a first flow passage to connect the second and third air inlet/outlet ports, the fan member being located in the first flow passage.

3. The developing device as claimed in claim 2, wherein the at least one fan member is installed on a rotary shaft of the at least one of the image carrier and the developer carrier, so that the at least one fan member can be rotationally driven in unison with the at least one of the image carrier and the developer carrier.

4. The developing device as claimed in claim 3, wherein the fan member is formed in a shape to control the air to be suctioned into the casing through the second air/inlet port when the fan member is rotated.

5. The developing device as claimed in claim 3, wherein the fan member is formed in a shape to control air to pass through the first air inlet/outlet port and the second air inlet/outlet port in sequence and to be suctioned into the at least one casing when the fan member is rotationally driven.

6. The developing device as claimed in claim 5, wherein the developer scattering prevention unit further comprises a filter member installed downstream of the third air inlet/outlet port along an air flow direction.

7. The developing device as claimed in claim 6, further comprising a housing to enclose the image carrier and the developer carrier and having a fourth air inlet/outlet port formed on a side wall thereof, wherein the filter member is installed to enclose the fourth air inlet/outlet port formed through the side wall of the housing enclosing the image carrier and the developer carrier, so that the fourth air inlet/outlet port is connected with the third air inlet/outlet port.

8. The developing device as claimed in claim 6, wherein the filter member is removably installed on a side of the casing to cover the third air inlet/outlet port and has a surface area larger than a cross-sectional area of the third air inlet/outlet port.

9. The developing device as claimed in claim 5, wherein the vacuum source is installed on one end of the at least one of the image carrier and the developer carrier, and the developing unit further comprises a second flow passage formed within the air inlet/outlet pipe to connect the first and second air inlet/outlet ports and formed in a shape which is gradually narrowed as being away from the second air inlet/outlet port.

10. The developing device as claimed in claim 5, wherein the vacuum source is installed on one end of the at least one of the image carrier and the developer carrier, and the first air inlet/outlet port is formed in a shape which is gradually widened as being away from the second air inlet/outlet port.

11. The developing device as claimed in claim 5, wherein the at least one vacuum source comprises a pair of vacuum sources installed on opposite ends of the at least one of the image carrier and the developer carrier, and the developing unit further comprises a second flow passage formed within the air inlet/outlet pipe to connect the first and second air inlet/outlet ports and formed in a shape which is gradually narrowed as approaching from the second air inlet/outlet port to a center part of the air inlet/outlet pipe.

12. The developing device as claimed in claim 5, wherein the at least one vacuum source comprises a pair of vacuum sources installed on opposite ends of the at least one of the image carrier and the developer carrier, and the first air inlet/outlet port is formed in a shape which is gradually widened as approaching from the second air inlet/outlet port to a center part of the air inlet/outlet pipe.

13. The developing device as claimed in claim 5, wherein the first air inlet/outlet port is formed in a slit shape longitudinally parallel to a main axis of the at least one of the image carrier and the developer carrier.

14. The developing device as claimed in claim 5, wherein a traveling direction of air passing through the second and third air inlet/outlet ports is parallel to a main axis of the at least one of the image carrier and the developer carrier.

15. The developing device as claimed in claim 5, wherein a traveling direction of air passing through the second air inlet/outlet port is parallel to a main axis of the at least one of the image carrier and the developer carrier, which is formed in a roller shape, and a traveling direction of air passing through the third air inlet/outlet port is inclined to the main axis by a predetermined angle.

16. The developing device as claimed in claim 15, wherein the at least one causing comprises a portion wall, the fan member is formed in a centrifugal fan, the first flow passage is formed along an inner circumferential surface of the at least one casing by the partition wall formed within the casing, and the second and third air inlet/outlet ports are isolated from each other and connected with each other only via the first flow passage.

17. A developing device used with an electrophotographic image forming device, comprising:

an image carrier;

a developer carrier to feed a developer to the image carrier; and a developer scattering prevention unit to prevent the developer from scattering between the image carrier and the developer carrier, the developer scattering prevention unit comprising, an air inlet/outlet pipe installed adjacent to an intermediate area between the image carrier and the developer carrier, and having a first air inlet/outlet port being open toward the intermediate area, and at least one vacuum source installed to communicate with the air inlet/outlet pipe to control air to flow through the first air inlet/outlet port, wherein the air inlet/outlet pipe is formed with an air passage therein to connect the first air inlet/outlet pipe and the at least one vacuum source, the air passage having a cross-section which is different according to a distance to the at least one vacuum source.

18. The developing device as claimed in claim 17, wherein the air passage is formed in a shape which is gradually narrowed as being away from the at least one vacuum source.

19. The developing device as claimed in claim 17, wherein the first air inlet/outlet port has a cross-section which is different according to a distance to the at least one vacuum cleaner.

20. The developing device as claimed in claim 19, wherein the first air inlet/outlet port is formed in a shape which is gradually widened as being away from the at least one vacuum source.

21. The developing device as claimed in claim 17, wherein the at least one vacuum source comprises:

at least one fan member rotatably installed at one or more ends of at least one of the image carrier and the developer carrier; and at least one casing to enclose the at least one fan member, and comprising a second air inlet/outlet port connected to the air inlet/outlet pipe, a third air inlet/outlet port connected to the second air inlet/outlet port to communicate with air through the second air inlet/outlet port, and a first flow passage to connect the second and third air inlet/outlet ports, the fan member being located in the first flow passage.

22. The developing device as claimed in claim 21, wherein the at least one of the image carrier and the developer carrier comprises a rotary shaft, and the at least one fan member is installed on the rotary shaft of the at least one of the image carrier and the developer carrier, so that the least one fan member can be rotationally driven in unison with the at least one of the image carrier and the developer carrier as the at least one of the image carrier and the developer carrier rotates.

23. A developing device used with an electrophotographic image forming device, comprising:

an image carrier;

a developer carrier to feed a developer to the image carrier; and a developer scattering prevention unit to prevent the developer from scattering between the image carrier and the developer carrier, the developer scattering prevention unit comprising:

an air inlet/outlet pipe installed adjacent to an intermediate area between the image carrier and the developer carrier, and having a first air inlet/outlet port being open toward the intermediate area, and at least one vacuum source installed to communicate with the air inlet/outlet pipe to control the air to flow through the first air inlet/outlet port, wherein the first air inlet/outlet port has a cross-section which is different according to a distance to the at least one vacuum source.

24. The developing device as claimed in claim 23, wherein the first air inlet/outlet port is formed in a shape which is gradually widened as being away from the at least one vacuum cleaner.

25. The developing device as claimed in claim 23, wherein the at least one vacuum source comprises:

at least one fan member rotatably installed at one or more ends of at least one of the image carrier and the developer carrier; and at least one casing to enclose the at least one fan member, and comprising a second air inlet/outlet port connected to the air inlet/outlet pipe, a third air inlet/outlet port connected to the second air inlet/outlet port to communicate with the second air inlet/outlet port, and a first flow passage to connect the second and third air inlet/outlet ports, wherein the at least one fan member is located in the first flow passage.

26. The developing device as claimed in claim 25, wherein the at least one of the image carrier and the developer carrier comprises a rotary shaft, and the at least one fan member is installed on the rotary shaft of the at least one of the image carrier and the developer carrier, so that the least one fan member can be rotationally driven in unison with the at least one of the image carrier and the developer carrier as the at least one of the image carrier and the developer carrier rotates.

27. An electrophotographic image forming apparatus, comprising:

a photoconductive body;

a developing roller to supply a developer to the photoconductive body; and a scatter prevention unit formed integrally with the developing roller to prevent the developer from scattering between the photoconductive body and the developing roller, and the scatter prevention unit including an air pipe extending along a length of the developing roller, at least one inlet port disposed at a predetermined location along the air pipe, and at least one fan disposed at an end of the air pipe to be rotatable by a rotational movement of the developing roller.

* * * * *